US007604230B2

(12) United States Patent
Bartick et al.

(10) Patent No.: US 7,604,230 B2
(45) Date of Patent: Oct. 20, 2009

(54) METHOD OF PROVIDING MULTIPLE SEPARATION MODES IN A FEEDER

(75) Inventors: Theresa A. Bartick, Gorham, ME (US); James A. Fairweather, Milford, CT (US); Thomas M. Lyga, Southbury, CT (US); Christopher D. Clark, Lempster, NH (US)

(73) Assignee: Pitney Bowes Inc., Stamford, CT (US)

( * ) Notice: Subject to any disclaimer, the term of this patent is extended or adjusted under 35 U.S.C. 154(b) by 243 days.

(21) Appl. No.: 11/786,935

(22) Filed: Apr. 13, 2007

(65) Prior Publication Data

US 2008/0012198 A1 Jan. 17, 2008

Related U.S. Application Data

(60) Provisional application No. 60/795,796, filed on Apr. 28, 2006.

(51) Int. Cl.
*B65H 5/00* (2006.01)

(52) U.S. Cl. ..... 271/10.13

(58) Field of Classification Search ..... 271/10.132, 271/9.07, 110, 125, 10.13
See application file for complete search history.

(56) References Cited

U.S. PATENT DOCUMENTS 5,664,771 A 9/1997 Nagatani et al.
5,887,867 A 3/1999 Takahashi et al.
7,413,185 B2 * 8/2008 Mitsuya et al. ..... 271/125
7,455,286 B2 * 11/2008 Klaffenbach et al. ..... 271/114
2005/0082739 A1 4/2005 Mitsuya et al.

* cited by examiner

*Primary Examiner*—Kaitlin S Joerger
(74) *Attorney, Agent, or Firm*—Ronald Reichman; Angelo N. Chaclas

(57) ABSTRACT

Discrete means of setting a feeder to process a wide range of media, i.e., sheets, slips, envelopes, booklets and hand collated documents, etc. as well as providing a method of utilizing the feeder for manual feed operation. The foregoing is accomplished by a friction-clutch retard feeder equipped with one or more friction clutches. When a selection lever is moved to a position 1, a primary clutch engages the separator roller with a resistive torque $T_1$. The selection lever configures the mechanism such that the separator roller rotation is resisted entirely by the torque of the primary clutch. When the selection lever is moved to a position 2, the ground of the primary clutch is removed, and the rotation of the separator roll is coupled through a gear ratio to a secondary clutch. The selection of the gear ratio and the value of the secondary clutch allows the separation mechanism to be resisted by a second torque, $T_2$, which can be lower than $T_1$.

12 Claims, 4 Drawing Sheets

METHOD OF PROVIDING MULTIPLE SEPARATION MODES IN A FEEDER

This Application claims the benefit of the filing date of U.S. Provisional Application No. 60/795,796 filed Apr. 28, 2006, which is owned by the assignee of the present Application.

FIELD OF THE INVENTION

The invention relates generally to sheet folding and inserting machines, and more particularly to, a method for providing multiple separation modes in a feeder.

BACKGROUND OF THE INVENTION

Friction feeders are known in the art. As the name suggests, a friction feeder relies on the interaction of several components around the exit nip of the feeder that results in the singulation of paper documents in a paper stack. The common components in most friction feeders are the driving mechanism to drive a sheet of paper documents out of the exit nip and the retarding element to retain all the other sheets in the stack so as to prevent multiple feeds. To provide the necessary friction for retaining the other sheets in the stack, the surface of the retarding element is usually made of an elastomeric material or a hard, rough coating.

A friction feeder may be designed to operate as a top feeder or a bottom feeder. In bottom feeders, the sheets generally are in a vertical stack and are moved out the stack, one at a time, by a driving mechanism below the stack. A driving mechanism is used to drive the bottom sheet of a stack out of the exit nip and a retarding element, i.e., a cylindrical member is used to hold back the other bottom sheets. In general, the retarding element has a relatively large diameter at the exit nip so that a number of sheets at the bottom of the stack can fan out to follow the surface curvature of the retarding element, forming a singulated stack portion. In the singulated portion, the sheets are slightly separated from each other in that the leading edge of one sheet is positioned slightly ahead of the sheets above. The driving mechanism comprises a continuous belt mounted on a pair of rollers. However, the driving mechanism can simply be rollers with a resilient surface.

In top feeders, the sheets generally are in a vertical stack and are moved out the stack, one at a time, by a driving mechanism above the stack. A driving mechanism is used to drive the top sheet of a stack out of the exit nip and a retarding element, i.e., a cylindrical member is used to hold back the other top sheets.

In the design of friction retard feeders, a balance exists between the separation forces imparted to a media item and the forces that the media item can withstand prior to shearing or deforming. Often it is the case that media items requiring high separation forces can withstand high separation forces, while media items requiring low separation forces (e.g. booklets) can withstand only low separation forces. Differing feeder technologies address the problem in alternate ways.

To accomplish the feeding of both sheets and booklets in a typical friction-clutch retard feeder two separate feeders would be designed; one that imparts high separation forces, and a second that imparts low separation forces. Thus, a specific feeder would be used to feed a specific material.

In gap-based separators, an analog or discrete adjustment of the feeder gap may allow the feeder separation forces to be adjusted over a range of values. Such a feeder is very capable of feeding media requiring both high and low separation forces, but the adjustment of the gap to feed thin materials such as sheets and slips can be very difficult and cumbersome, and this adjustment process is one of the key usability issues associated with gap feeder technology.

Lastly, in almost all mail creation systems, it is desirable to create a feeder input that imparts no separation force to the material, allowing it to pass freely into the machine. Such an operating mode is termed "daily-mail" or "manual-feed" and is a very desirable feature in mail creation equipment.

SUMMARY OF THE INVENTION

This invention overcomes the disadvantages of the prior art by providing a clear and discrete means of setting a feeder to process a wide range of media, i.e., sheets, slips, envelopes, as well as multi sheet sets such as booklets, pamphlets and hand collated documents, etc. In addition the invention provides a method of utilizing the feeder for manual feed operation.

An advantage of the foregoing is that a single common feeder may be provided to the customer that is capable of feeding a broad range of material.

Another advantage is that for a given number of feeders a wider range of mail creation jobs may be processed.

A further advantage is that a user may easily set a mode of the feeder through a discreet adjustment.

The invention accomplishes the foregoing by a friction-clutch retard feeder equipped with one or more friction clutches. When a selection lever is moved to a position 1, a primary clutch engages the separator roller with a resistive torque T1. The selection lever configures the mechanism such that the separator roller rotation is resisted entirely by the torque of the primary clutch. When the selection lever is moved to a position B, the ground of the primary clutch is removed, and the rotation of the separator roll is coupled through a gear ratio to a secondary clutch. The selection of the gear ratio and the value of the secondary clutch allows the separation mechanism to be resisted by a second torque, T2, which can be lower than T1.

Thus, using the mechanism described above, a principal feeding mode, Operation Mode 1, can be provided for materials requiring a specific range of separation shear forces, i.e., sheets, high basis weight paper, sheets having a high paper to paper friction coefficient ($\mu$=0.6 to 0.8) or images that are strongly affixed to the paper. A secondary mode, Operation Mode 2, can be provided for materials requiring a different lower range of separation shear forces, i.e., booklets, pamphlets, low basis weight paper, sheets having a low paper to paper friction coefficient ($\mu$=0.1 to 0.5) or images that are weakly affixed to the paper. The transition from the first feed mode to the second feed mode is both discrete and obvious to the user, which is a desirable aspect to the adjustment and obviates one of the disadvantages of the old methods of solving the problem.

Through the selection of components in the mechanism described above, it is also possible to make Operation Mode 2 impart no resistive forces to the media by the selection of a zero resistive torque level for the second clutch. Thus, the invention also provides a method of implementing a "daily-mail" or "manual-feed" mode of operation.

It is obvious that the invention could be extended to provide any number of feed modes through the use of multiple lever settings and clutches and appropriate mechanical means to configure the mechanism through the selection lever.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention. As shown throughout the drawings, like reference numerals designate like or corresponding parts.

DETAILED DESCRIPTION OF THE PRESENT INVENTION

Figure 1:
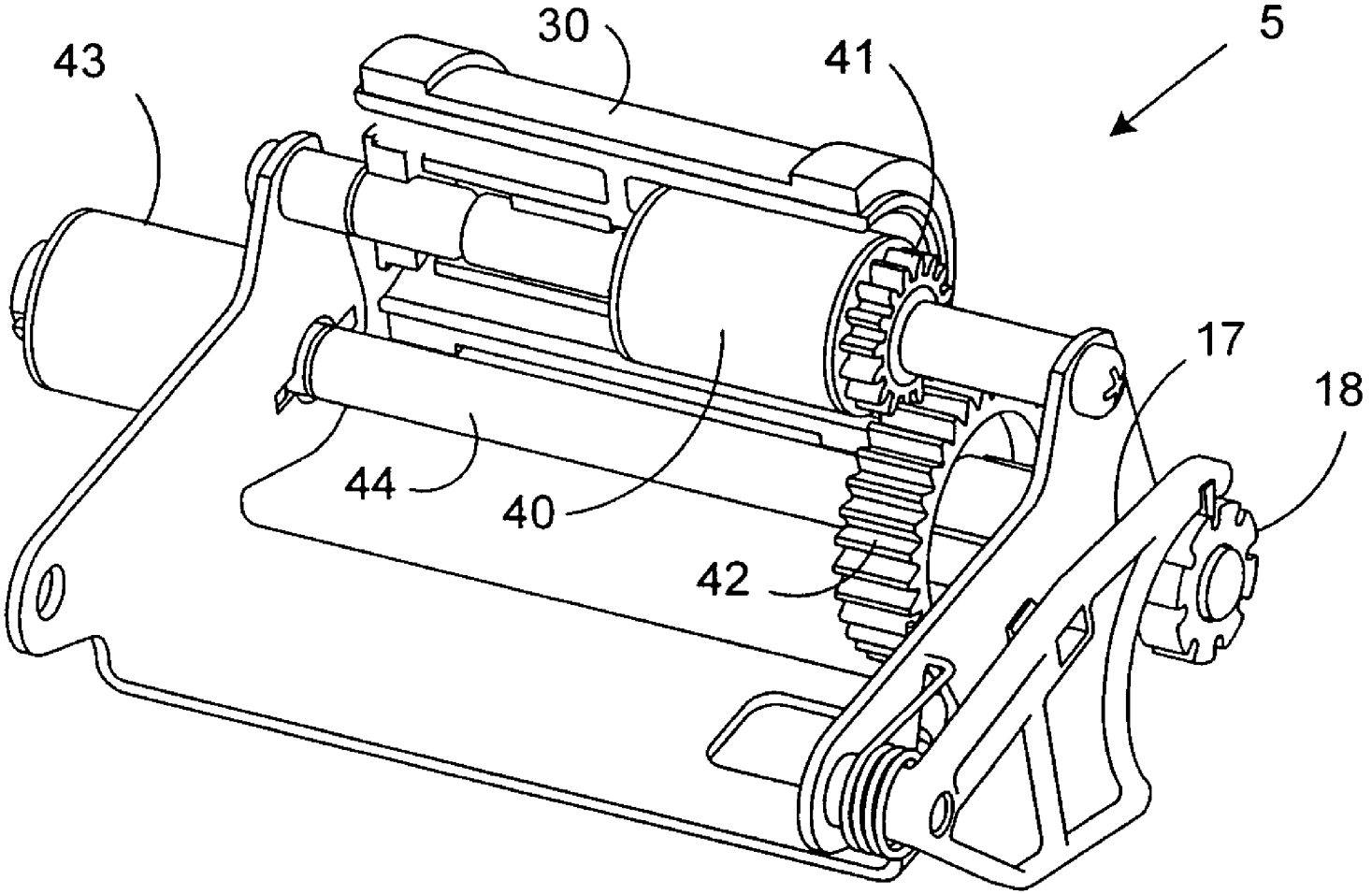
FIG. 1 is a separator assembly having two clutches that provide two modes of separation.

Referring now to the drawings and particularly to FIG. 1, the reference character 30 shows a separator which is coupled to a clutch gear 41 through a friction clutch 40. The ground path of clutch gear 41 includes transfer gear 42, common shaft 44, pawl gear 18 and pawl 17. When pawl 17 engages pawl gear 18, the common shaft 44 is prevented from rotating. The attached transfer gear 42 is therefore immobile and rotation of the separator roller 30 requires frictional slip in the frictional clutch 40. When pawl 17 pivots about the pawl axis 19, pawl gear 18 is freed which allows common shaft 44 to rotate. The ground path of clutch gear 41 then follows a path from transfer gear 42 through common shaft 44 through friction clutch 43 to support bracket 45. The full assembly as described comprise separator assembly 5.

It is the ratio of the diameter of the clutch gear 41 to transfer gear 42 that determines whether the separation roller 30 slip resistance will be provided by friction clutches 40 or 43. If the diameter of the receiving gear 42 is larger than the diameter of the clutch gear 41 and clutches 40 and 43 have approximately equal torque resistance the net torque resistance applied to separator roller 30 in this configuration will be the ratio of the clutch gear diameter to the transfer gear diameter multiplied by the torque of friction clutch 43. If friction clutch 43 were removed from the system or was selected to be a small torque i.e., 0.1 ounce/inch, separator roller 30 would turn freely.

Figure 2:
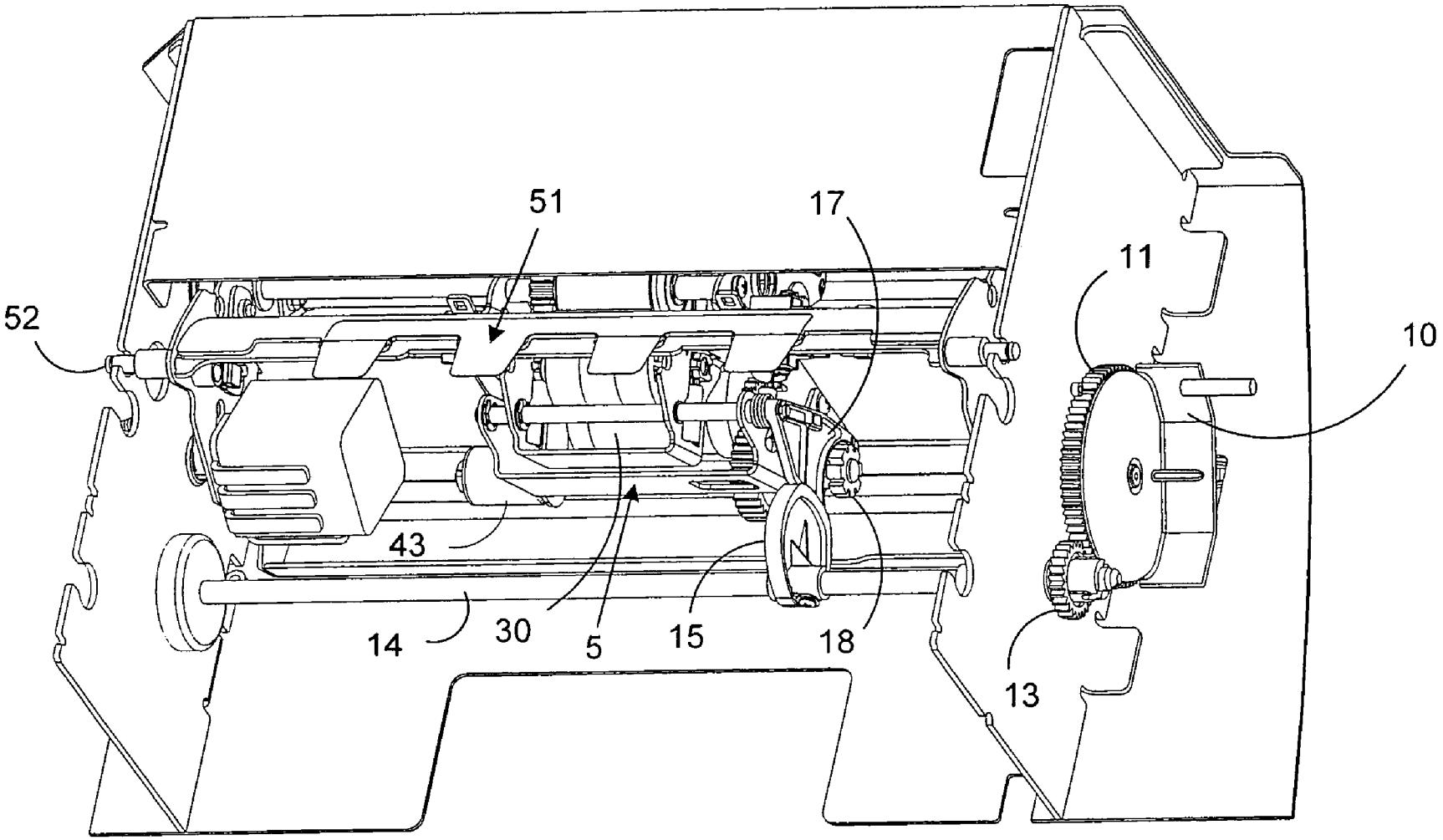
FIG. 2 is a feeder tower containing a feed head having the separator assembly of FIG. 1.

FIG. 2 is a feeder tower containing a feed head 51 having the separator assembly 5 of FIG. 1. When switch 10 is in position B it displaces a segment gear 11, which has driven gear 13. Gear 13 is on shaft 14 with pawl lift cam 15 and a head lift cam 16. The rotation of gear 13 has caused head lift cam 16 (FIG. 4) to contact the lift surface 50 (FIG. 4) on feed head 51 locking the position of feed head 51 with respect to the shaft axis 52. Simultaneously pawl lift cam 15 has displaced pawl 17 freeing pawl gear 18 and causing feed head 51 to operate at a reduced torque at the reduced separator roller 30. It can be seen from FIG. 2 that the action of locking feed head 51 position via feed lift cam 50 allows for precise interaction between pawl lift cam 15 and pawl 17.

Figure 3:
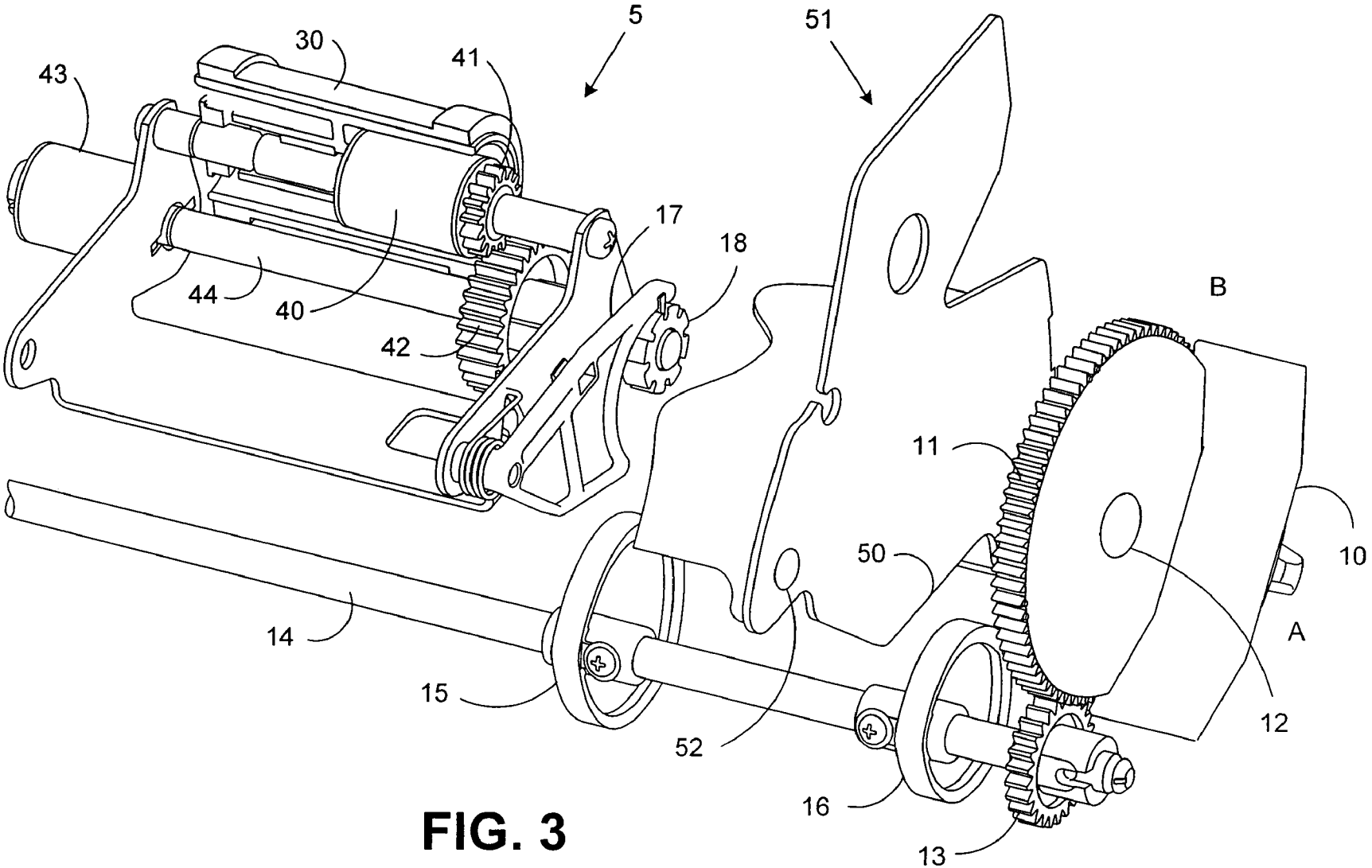
FIGS. 3 and 4 are drawings of the selection lever and the mechanism by which it communicates to the separator system of FIGS. 1 and 2.
Figure 4:
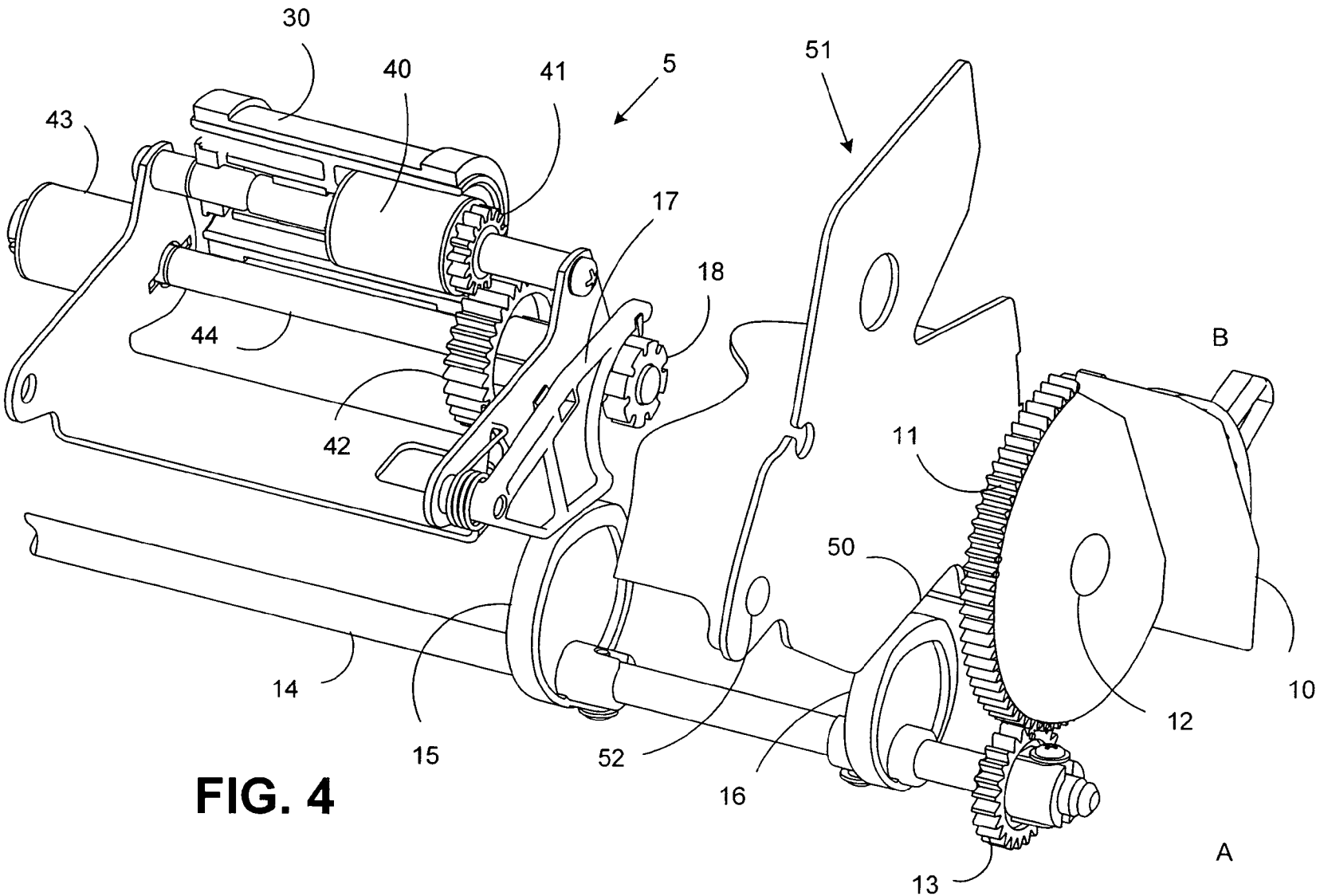

Illustrated in FIGS. 3 and 4 is a user adjustable mode switch that activates a mechanical system that displaces a cam to one of two discreet positions based upon the state of the switch. In position A the cam does not engage the separator assembly and a torque T1 is applied to the separator roller.

In position B the cam engages the surface of a pawl and a torque T2 is applied to the separator roller. The displacement of the pawl frees the system to rotate against the friction clutch 43. Alternatively in the absence of a friction clutch number 43 the roller is able to freely rotate and a manual feed mode is enabled.

FIG. 3 shows switch 10 in position A. The segment gear 11 has disposed gear 13, which has turned shaft 14 and the attached cams 15 and 16 such that pawl lift cam 15 is not in contact with separator pawl 17 and the head lift cam 16 is not in contact with the feed head lift surface 50 (FIG. 2). In this configuration the pawl gear 18 is locked in position by the separator pawl 17 (FIG. 1). Likewise the transfer gear 42 is locked in position due to its connection to the pawl gear 18 through a common shaft 44. Separator roller 30 has a resistive torque applied to it by friction clutch 40. Clutch gear 41 and transfer gear 42, shaft 44, pawl gear 18 and pawl 17 provide a rigid path to ground for friction clutch 40.

In FIG. 4 switch 10 Is in position B. Switch 10 is connected to segment gear 11 the motion of switch 10 causes segment gear 11 to pivot around a gear axis 12. The motion of segment gear 11 is coupled to the motion of gear 13 which is attached to shaft 14. A pawl lift cam 15 and a head lift cam 16 are also connected to shaft 14. When switch 10 moves from position A to position B, pawl lift cam 15, causes separator pawl 17 to pivot and release from the pawl lift gear 18. When pawl lift gear 18 is free the torque provided to separator roller 30 is produced by the mechanical interaction of the friction clutch 40, the clutch gear 41, the transfer gear 42 and the friction clutch 43. In the above configuration there is no slip in friction clutch 40.

Another result of moving switch 10 from position A to position B is that the head lift cam 16 contacts a lift surface 50 on the feed head 51 to pivot about a shaft axis 52 and thus, locking the position of feed head 51. With the position of feed head 51 locked the interaction between pawl lift cam 15 and separator pawl 17 can be easily controlled.

It is obvious to one skilled in the art that additional separation forces may be achieved by providing a lever mechanism and an appropriate separator system having additional clutches, pawls and ratchet.

The above specification describes a new and improved method for providing multiple separation modes in a feeder. It is realized that the above description may indicate to those skilled in the art additional ways in which the principles of this invention may be used without departing from the spirit. Therefore, it is intended that this invention be limited only by the scope of the appended claims.

What is claimed is:

1. A method for providing separation modes in a feeder, the method comprising the steps of:

selecting a first operating mode;

configuring a friction clutch separator to the first operating mode in order to supply a resistive torque $T_1$ provided by a first friction clutch to a separator roller;

selecting a second operating mode; and configuring the friction clutch separator to the second operating mode in order to supply a resistive torque $T_2$ provided by a second friction clutch to the separator roller, wherein in the second operating mode the resistive torque $T_2$ is less than the resistive torque $T_1$.

2. The method claimed in claim 1, wherein shear forces for separating paper sheets in the feeder is reduced.

3. The method claimed in claim 1, wherein $T_2$ is equal to a ratio of a first gear pitch diameter divided by a second gear pitch diameter multiplied by the torque of the second friction clutch.

4. The method claimed in claim 1, wherein the second operating mode is used to separate multiple sheet sets.

5. The method claimed in claim 1, wherein the first operating mode is used to separate single sheets.

6. The method claimed in claim 1, wherein the second operating mode is used to separate multiple sheet sets.

7. The method claimed in claim 1, wherein the second operating mode imparts a lower separation shear than the first operating mode.

8. The method claimed in claim 7, wherein the second operating mode is used for low basis weight paper and the first operating mode is used for high basis weight paper.

9. The method claimed in claim 7, wherein the first operating mode is used for images that are affixed to paper better than the images affixed to paper in second operating mode.

10. The method claimed in claim 7, wherein the first operating mode is used for sheets having a high sheet to sheet friction coefficient and the second operation mode is used for sheets having a lower friction coefficient than the sheets in the first operating mode.

11. The method claimed in claim 1, further including the steps of:

providing additional operating mode selections; and configuring the friction clutch separator to additional torques based upon the additional mode selected.

12. The method claimed in claim 11, wherein the additional modes supply successively decreasing separator roller resistive torques.

* * * * *